United States Patent [19]

Hayakawa

[11] 4,130,858

[45] Dec. 19, 1978

[54] LAMP-MOVING DEVICE

[75] Inventor: Yoshito Hayakawa, Kohnosu, Japan

[73] Assignee: Yamada Iryo Shomei Kabushiki Kaisha, Tokyo, Japan

[21] Appl. No.: 787,257

[22] Filed: Apr. 13, 1977

[30] Foreign Application Priority Data

Apr. 30, 1976 [JP] Japan ..... 51/53278

[51] Int. Cl.[2] ..... F21S 1/02; E01B 25/22; F21S 1/04; F21S 3/02

[52] U.S. Cl. ..... 362/150; 104/108; 362/404; 362/424

[58] Field of Search ..... 362/404, 405, 147, 150, 362/424; 105/163 R, 155, 104/94, 108

[56] References Cited

U.S. PATENT DOCUMENTS

| | | | |
|---|---|---|---|
| 1,972,931 | 9/1934 | Haddlesay | 104/108 |
| 3,051,772 | 8/1962 | Davis | 362/404 |
| 3,086,478 | 4/1963 | Schreyer | 104/108 |
| 3,504,172 | 3/1970 | Liberman | 362/150 |
| 3,577,930 | 5/1971 | Rooklyn | 104/108 |
| 3,580,183 | 5/1971 | Nearman | 104/108 |

*Primary Examiner*—Samuel W. Engle
*Assistant Examiner*—Donald P. Walsh
*Attorney, Agent, or Firm*—Wenderoth, Lind & Ponack

[57] ABSTRACT

The present invention relates to a device for moving lamps used in clinical situations.

The moving device has rails and a support which is movable on these rails. The rails are buried in the ceiling and the lamp is suspended from the support. The lamp is movable across an opening provided in the bottom of the rails. A belt is stretched across the total area of said opening to completely seal the opening; the downward support for the lamp passes through this belt; and the belt is movable together with the movement of the lamp.

8 Claims, 3 Drawing Figures

LAMP-MOVING DEVICE

BACKGROUND OF THE INVENTION

To move lamps which are mainly intended for clinical use, there are several known devices. In one device, rails and a support movable on these rails are buried in the ceiling; lamps are suspended from this support; and the lamps are movable across an opening provided in the ceiling. In this conventional device, however, the opening is left open without being sealed. As time passes, dust collects in said opening and with an air draft in the room or movement of the lamps, the collected dust falls and spreads, thereby destroying the cleanliness of the room.

Recently, a "clean air" system which assures a sterile, dust-free condition by driving out foul air and introducing fresh, clean air through the ceiling has become increasingly adopted for use mainly in surgical operating rooms.

When the conventional illuminating lamp moving device is used in a room equipped with such a "clean air" system, a turbulence develops around the opening in the ceiling due to the clean air stream and in consequence of this turbulence, the diffusion of dust collected in the opening becomes intense and spoils the sterile condition of the room.

Further this lamp is simply hung on the outside through the opening, and is unsightly.

Also, the conventional device in which, say, the slidable contact for ignition of lamps is easily accessible from the outside involves a hazard of electric shock, which is undesirable from a standpoint of safety.

For these reasons, a lamp-moving device in which the ceiling opening is always sealed, no matter how the lamps are moved and no matter in what position the lamps are located, is necessary.

OBJECT OF THE INVENTION

The primary object of the present invention is to provide a lamp-moving device in which the opening is always sealed, regardless of the movement and position of the lamps.

Another object of the present invention is to provide a lamp-moving device which is not bared to the outside through the opening.

Still another object of the present invention is to provide a lamp-moving device which does not spoil the appearance of the room in which it is installed.

Still another object of the present invention is to provide a lamp-moving device which takes up so small an area that it can be readily installed in addition to the existing equipment and which is so simplified in structure that it can be very easily maintained, inspected or repaired.

Still another object of the present invention is to provided a lamp-moving device which is continuously sealed when the lamps are at rest as well as when they are moving.

Still another object of the present invention is to provide a lamp-moving device which needs no particular drive source.

Still another object of the present invention is to provide a lamp-moving device which serves no operation other than the moving of lamps.

BRIEF DESCRIPTION OF THE DRAWINGS

The lamp-moving device according to the present invention will be better understood by reading the following detailed description of the invention with reference to the attached drawings.

DETAILED DESCRIPTION OF THE INVENTION

Figure 1:
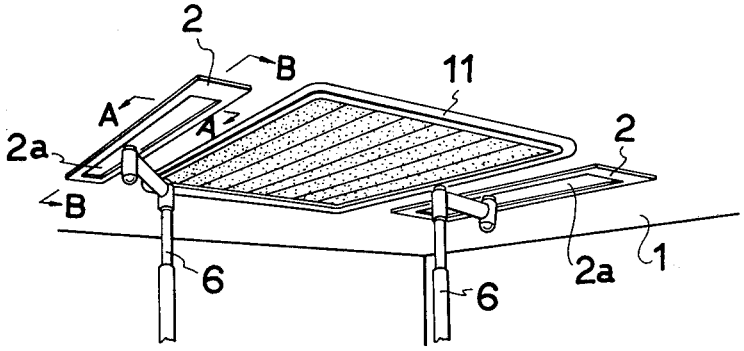
FIG. 1 is an oblique view illustrating the lamp-moving device as installed for practical use.

Referring to the drawings, the lamp-moving device according to the present invention is to be described. In the drawings, like parts are denoted by like numbers.

In the ceiling of the operating room, rails 2 are secured by means of anchor bolts. The rails 2 are hollow boxes, and on the bottom surfaces 2*b* of the rails is a rectangular opening 2*a* in the longitudinal direction.

Inside the rails 2 is held a base 3. At midpoint of the base 3, the upper end of the lamp-suspending arm 6 is attached. The lamp-suspending arm 6 hangs down through the opening 2*a* and has at the lower end thereof an illuminating lamp (not shown) which is movable in the vertical direction and has a variable angle. Two pairs of wheels 4 and rollers 5 are rotatable at the front and rear of the base, respectively. The wheels 4 are attached to both sides of the base 3 in such a manner that they can travel over the bottom surface 2*b* on both sides of the opening 2*a* of the rails 2. When the wheels 4 travel, the base 3 moves within the rails 2. The rollers 5 are horizontally attached to both sides of the base 3 so that they can travel closely against the inside of both sides 2*c* of the rails 2. Because of these rollers 5, the moving orbit of the base 3 can always be held centrally in a specific position on the rail 2.

The opening 2*a* covers the movable range of the lamp-suspending arm 6, which moves together with the base 3. A pair of belt support drums 7 are rotatably fitted to both ends 2*d* of the rails 2, and at least one of these drums 7 is attached over a spring type support arm 8, which adjusts the tightness of a belt 9. The spacing of these drums 7 is set longer than the length of the opening 2*a*.

The endless loop belt 9 is wider than the opening 2*a*, and is stretched over the pair of belt-support drums 7. The belt 9 is maintained in a constant tension by the spring-type support arm 8.

The bottom part of the belt 9, which is wider and longer than the opening 2*a*, is stretched high enough to touch the bottom surface 2*b* of the rail 2. Therefore, the pair of belt support drums 7 is set at such a position to hold the belt 9 at that height. Accordingly, the bottom part of the belt 9 covers the opening 2*a* in the bottom surface 2*b* of the rail 2.

Both sides of the bottom part of the belt 9 contact a pair of belt guides 10 with no gap. Said pair of belt guides 10, which are longer than the opening 2*a*, are installed opposite to each other above the bottom surface 2*b* on both sides of the opening 2*a*. These belt guides 10 set the belt 9 in position so that the belt 9 covers and seals the opening 2*a*, and the lamp-suspending arm 6 hanging downward from the base 3 penetrates through the belt 9.

Figure 3:
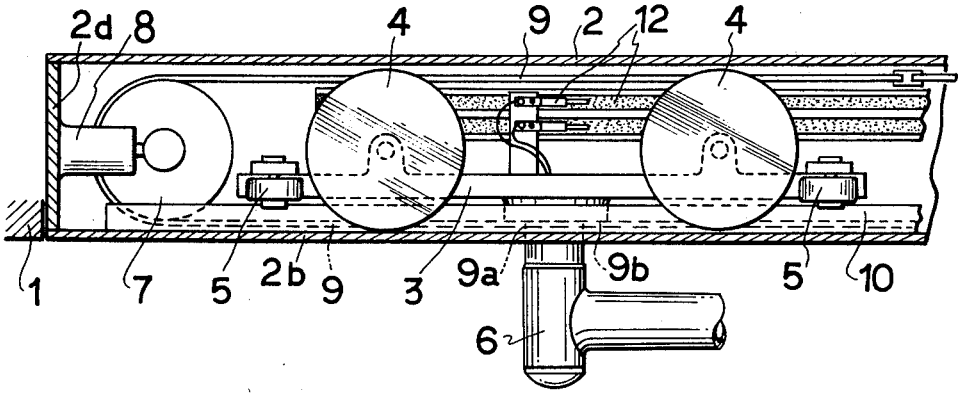
FIG. 3 is a view taken along the section line B—B in FIG. 1.

As clearly seen from FIG. 3, the belt 9 is attached to the lamp-suspending arm 6 with no gap at the point of its penetration 9*a* and to the base 3 with no gap at the point of its contact 9*b*. Thus, the opening 2*a* of the rail 2 is sealed with the belt 9 and through this belt 9 the lamp-suspending arm 6 hangs down.

In FIG. 1, an air cleaner orifice 11 commonly provided in the ceiling of the operating room is shown.

Figure 2:
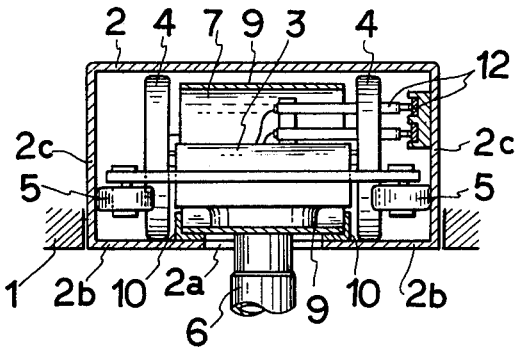
FIG. 2 is a view taken along the section line A—A in FIG. 1.

In FIGS. 2 and 3, a slidable electric contact 12 is provided to supply power to the lamp.

In the lamp-moving device thus constituted, when the lamp is to be moved, a force is applied to the lamp or the lamp-suspending arm 6 in the desired longitudinal direction along the rail 2. This force is usually applied by a man who handles the lamp. The wheels 4 and the rollers 5 support the base 3 for easy movement within the rail 2 in the longitudinal direction, so the base 3 can be moved by a force applied through the lamp or lamp-suspending arm 6. Together with the movement of the base 3, the lamp-suspending arm 6 fixed to the base 3 and the lamp attached to the lamp-suspending arm 6 are moved to a desired position.

Meanwhile, the opening 2*a* of the rail 2 is totally sealed with the bottom part of the belt 9, and the lamp-suspending arm 6 hangs down through the belt 9.

Since the belt 9 is rotatably held by the pair of support drums 7 and the contact between the lamp-suspending arm 6 and the base 3 is fixed, the belt 9 as stretched over the pair of support drums 7 can move together with the base 3 and the lamp-suspending arm 6.

Thus, whatever the moving positions of the base 3 and the lamp-suspending arm 6 are, the opening 2*a* is invariably sealed by the bottom part of the belt 9.

The perfectness of this sealing is assured for the following reasons:

(a) The rollers 5 maintain the path of the base 3 at all times in the central portion of the rail 2. Therefore, even when the base 3 moves, the positional relation of the belt 9 to the opening 2*a* remains unchanged and the belt 9 never deviates from the opening 2*a*.

(b) The belt 9 is stretched with a constant tention by the spring type support arm 8.

(c) The belt 9 is positioned with both sides in gapless contact with the belt guides 10.

Power for illumination is supplied to the lamp through an electric contact 12.

It should be understood that the present invention is not confined to the illustrated embodiment, and that various other embodiments are possible without departing from the substance of the present invention.

According to the present invention, the opening, which is invariably sealed, cannot collect dust; and even if dust collects therein, it will not fall in the room. As a result, since there is no possibility that the air stream will disturb the dust, the room can be kept very clean.

Since the installation within the opening is not exposed, there is no hazard of electric shock, thereby enhancing the safety and the appearance.

The opening is sealed with the belt, and the belt is movable together with the lamp. Accordingly, the opening is always sealed in the same state and the sealing of the opening requires no special handling.

The belt itself works within the rails conventionally provided to move the illuminating equipment. Thus, with no major modification, the belt can be readily added to the existing installation.

In the case of a pair of belt-support drums which are rotatably fitted both ends of the rails and endless loop belt being stretched over these drums, the belt is movable by a slight force and no particular drive source is required.

Moreover, the structure is so simplified that maintenance, inspection or repair is very easy.

When the base is provided with rollers, the path of the base can always be maintained central to the rails, and when a spring-type support arm is employed, the belt can be stretched to a constant tightness. Finally, when the belt is guided, the belt can be rightly positioned and the belt and the opening can be brought into close contact with each other through the belt guides, whereby the opening can be perfectly sealed with the belt, regardless of the lamp position. Thus, the lamp-moving device according to the present invention is characterized by these various unprecedented features.

What is claimed is:

1. A lamp-moving device for moving a lamp mounted in a ceiling across the ceiling, said device comprising:
   - rail means embedded in said ceiling, flush therewith, and having a longitudinal opening therein flush with said ceiling;
   - lamp support means within and extending downward from said rail means through said opening for supporting and moving said lamp within said rail means; and
   - belt means surrounding and movable with said lamp support means within said rail means and positioned over said opening for sealing said opening.

2. A device as claimed in claim 1 wherein said rail means is comprised of a box-like structure embedded in said ceiling flush therewith, said structure having an opening running the length thereof on the bottom side flush with said ceiling, and said opening being spaced from the sides of said structure.

3. A device as claimed in claim 2 wherein said lamp support is comprised of:
   - a horizontal base within said box-like structure;
   - a lamp-suspending arm attached to said horizontal base and extending downward thereform through said opening and said belt means over said opening; and
   - wheel means on said horizontal base contacting said box-like structure for moving said base within said box-like structure.

4. A device as claimed in claim 3 wherein said wheel means is comprised of a plurality of first wheels attached to the sides of said base and contacting the bottom of said box-like structure on both sides of said opening.

5. A device as claimed in claim 4 wherein said wheel means is further comprised of a plurality of second wheels attached to the sides of said base, extending outward therefrom and in contact with the sides of said box-like structure.

6. A device as claimed in claim 1 wherein said belt means is comprised of:
   - a pair of belt-support drums, each rotatably mounted at opposite ends of said rail means; and
   - an endless loop belt stretched over said belt-support drums, completely covering and sealing said opening in said rail means, and surrounding said lamp support means.

7. A device as claimed in claim 6 wherein said belt means is further comprised of at least one spring-type support arm connecting at least one of said rotatable support drums to the end of said rail means.

8. A device as claimed in claim 6 wherein said belt means is further comprised of a plurality of belt guide means attached to the bottom of said rail means on both sides of said opening for contacting said belt and holding said belt tightly over said opening.

* * * * *